US008684756B2

(12) United States Patent
Kobayashi et al.

(10) Patent No.: US 8,684,756 B2
(45) Date of Patent: Apr. 1, 2014

(54) LEVER-TYPE CONNECTOR

(75) Inventors: Tohru Kobayashi, Makinohara (JP); Shoji Yamamoto, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/502,630

(22) PCT Filed: Jan. 14, 2011

(86) PCT No.: PCT/JP2011/051039

§ 371 (c)(1),
(2), (4) Date: Apr. 18, 2012

(87) PCT Pub. No.: WO2011/087151

PCT Pub. Date: Jul. 21, 2011

(65) Prior Publication Data

US 2012/0208383 A1 Aug. 16, 2012

(30) Foreign Application Priority Data

Jan. 14, 2010 (JP) ..... 2010-006113

(51) Int. Cl.
*H01R 13/62* (2006.01)

(52) U.S. Cl.
USPC ..... 439/157; 439/372

(58) Field of Classification Search
USPC ..... 439/157, 372
See application file for complete search history.

(56) References Cited

U.S. PATENT DOCUMENTS

| | | | | |
|---|---|---|---|---|
| 7,234,952 | B2 | 6/2007 | Sasaki et al. | |
| 7,922,503 | B1 * | 4/2011 | Kobayashi et al. | 439/157 |
| 8,025,513 | B2 * | 9/2011 | Kobayashi et al. | 439/157 |
| 8,197,271 | B2 * | 6/2012 | Kobayashi et al. | 439/157 |
| 2002/0177338 | A1 | 11/2002 | Nishide et al. | |
| 2006/0228921 | A1 | 10/2006 | Fukui et al. | |
| 2007/0087599 | A1 | 4/2007 | Sasaki et al. | |
| 2012/0208383 | A1 * | 8/2012 | Kobayashi et al. | 439/133 |
| 2013/0122728 | A1 * | 5/2013 | Kobayashi et al. | 439/136 |

FOREIGN PATENT DOCUMENTS

| | | |
|---|---|---|
| JP | 2003-178837 A | 6/2003 |
| JP | 2006-294359 A | 10/2006 |
| JP | 2007-115443 A | 5/2007 |

OTHER PUBLICATIONS

Written Opinion (PCT/ISA/237) of the International Searching Authority, issued in corresponding International Application No. PCT/JP2011/051039 on Mar. 16, 2011.
International Search Report (PCT/ISA/210) issued by the International Searching Authority in corresponding International Application No. PCT/JP2011/051039 on Mar. 16, 2011.
Office Action issued Oct. 29, 2013 by the Japanese Patent Office in counterpart Japanese Application No. 2010-006113.

* cited by examiner

*Primary Examiner* — James Harvey
(74) *Attorney, Agent, or Firm* — Sughrue Mion, PLLC

(57) ABSTRACT

A lever-type connector includes a connector housing, a cover attached to the connector housing, a lever rotatably mounted on the connector housing. The lever is rotated in a situation that a mating connector is fitted to the connector housing in a half-fitted condition, thereby moving the mating connector with respect to the connector housing from the half-fitting condition to a completely fitting condition. A retaining portion is provided on the lever. A lock portion provided on the cover is engaged with the retaining portion when the lever has been rotated. A lever claw portion is provided on the retaining portion. The lock portion is provided on a distal end portion of the lock arm. A lock protection portion is provided on the retaining portion so as to be positioned away from a rotation center of the lever than the lever claw portion so that the lock protection portion covers the lock portion.

5 Claims, 6 Drawing Sheets

LEVER-TYPE CONNECTOR

TECHNICAL FIELD

This invention relates to a lever-type connector for fitting a mating connector thereto by rotating a lever.

BACKGROUND ART

As a conventional lever-type connector in which a mating connector is fitted thereto by rotating a lever, a lever-type connector disclosed, for example, in PTL 1 has been proposed. In this lever-type connector, by rotating a lever, a mating connector is drawn from a half-fitting position where the mating connector is half fitted to a connector housing to a proper fitting position, and by doing so, the fitting operation can be carried out easily, and also the reliability of the fitting operation, etc., can be achieved.

As shown in FIG. 6, the lever-type connector 100 includes the connector housing 101 in which terminals (not shown) each connected to a wire W is mounted, a cover 102 which is attached to the connector housing 101 and receives the wires W therein generally over a longitudinal range of the connector housing 101 to lead the wires W as a wire bundle to the exterior in such a manner that the directions of the wires W led out from a cavity 101*b* of the connector housing 101 toward the cover converge within the range of from 0° to 90° with respect to the direction of leading-out of the wires W, and the lever 103 rotatably (pivotally) mounted on the connector housing 101 so as to be rotated about rotation axis pins 101*a* on the connector housing 101.

The connector housing 101 has the cavity 101*b*, and the terminals each having the wire W connected thereto are mounted in the cavity 101*b*. The cover 102 is attached to the connector housing 101 to cover the outside of the cavity 101*b*. A lock retaining portion 104 is formed at the cover 102. The lock retaining portion 104 projects from the outer surface of the cover 102, and when this projecting portion is pressed, the lock retaining portion 104 is elastically deformed toward the inside of the cover 102.

The lever 103 is mounted so as to be rotated between a standby position and a lock position (shown in FIG. 6) with respect to the connector housing 101. Cam grooves 103*a* are formed in the lever 103.

Next, the operation for fitting the mating connector (not shown) will be described.

First, the operator inserts the mating connector into the connector housing 101 from a direction of arrow A, and sets the mating connector in a half-fitting position where cam pins (not shown) of the mating connector are engaged respectively in the cam grooves 103*a* of the lever 103. Then, when the lever 103 located in the standby position is rotated in a direction of arrow B, each cam pin receives a pressing force form the corresponding cam groove 103*a* as a result of the rotating of the lever 103, and the mating connector is gradually shifted toward a proper fitting position in the connector housing 101. Also, when the rotating lever 103 reaches a position just before the lock position, the lever 103 presses the lock retaining portion 104 of the cover 102, so that the lock retaining portion 104 is elastically deformed toward the inside of the cover 102 (in a direction of arrow F in FIG. 6). As a result, the lever 103 is allowed to rotate. When the lever 103 is rotated to the lock position, the mating connector is drawn into the proper fitting position. Also, when the lever 103 reaches the lock position, the lever 103 ceases to press the lock retaining portion 104, and the lock retaining portion 104 is elastically restored toward the outside of the cover 102 (in a direction opposite to the direction of arrow F in FIG. 6), and locks the lever 103.

Next, an operation for canceling the fitted condition of the mating connector will be described.

First, the operator depresses the lock retaining portion 104, and when the lever 103, located in the lock position, is rotated to the standby position, the mating connector is retracted from the proper fitting position to the half-fitting position. When the operator separates the mating connector, located in the half-fitting position, from the connector housing 101, this operation is completed.

CITATION LIST

Patent Literature

[PTL 1] JP-A-2007-115443

SUMMARY OF INVENTION

Technical Problem

In the above conventional connector housing 101, however, the lock retaining portion 104 of the cover 102 is exposed to the exterior when the lever 103 is locked, and therefore when an external force is inadvertently applied to the lock retaining portion 104, the lock retaining portion 104 is liable to be damaged and deformed, and the locked condition of the lever 103 is easily canceled, and therefore there has been encountered a problem that a lock holding force for the lever 103 is low.

Solution to Problem

Therefore, the present invention has been made in order to solve the problem of this conventional construction, and an object of the invention is to provide a lever-type connector in which damage and deformation are prevented, and a lock holding force is high.

In order to achieve the above object, according to the present invention, there is provided a lever-type connector comprising:

a connector housing configured to receive terminals connected respectively to end portions of electric wires;

a cover that is attached to the connector housing so as to lead the electric wires out to the exterior;

a lever that is rotatably mounted on the connector housing and is rotated in a situation that a mating connector is fitted to the connector housing in a half-fitted condition, thereby moving the mating connector with respect to the connector housing from the half-fitting condition to a completely fitting condition in which the mating connector is completely fitted to the connector housing;

a retaining portion that is provided on the lever; and a lock portion that is provided on a lock arm of the cover and is engaged with the retaining portion of the lever when the lever has been rotated thereby completely fitting the connector housing to the mating connector, wherein a lever claw portion is provided on the retaining portion;

wherein the lock portion is provided on a distal end portion of the lock arm;

wherein at least one of the retaining portion and the lock arm has elasticity; and wherein a lock protection portion is provided on the retaining portion so as to be positioned away from a rotation center of the lever than the lever claw portion so that the lock protection portion covers the lock portion.

Preferably, the lock arm has elasticity, and when the lever is rotated, the lever claw portion elastically deforms the lock arm, and then slides over the lock portion of the lock arm, so that a distal end engagement portion of the lock portion and the lever claw portion are engaged with each other in the proper fitting condition and the lock portion abuts against the lock protection portion by an elastic force of the lock arm.

Advantageous Effects of Invention

According to the present invention, the lock protection portion is provided on the retaining portion so as to be positioned away from a rotation center of the lever than the lever claw portion so that the lock protection portion can cover the lock portion. Therefore, after the lever claw portion and the lock portion are retainingly engaged with each other to thereby lock the lever, the lock protection portion covers the lock portion, and the lock portion can be positively prevented from damage and deformation.

Furthermore, since the lock protection portion covers the lock portion, the locked condition of the lever will not be canceled even when a force is applied to the lever from the exterior. Therefore, there can be provided the lever-type connector in which such damage and deformation are prevented, and the lock holding force is high.

Furthermore, according to the invention, the distal end engagement portion of the lock portion and the lever claw portion are engaged with each other, and also the lock portion abuts against the lock protection portion by the elastic force of the lock arm, and therefore a lock sound can be obtained, and a user can confirm from this lock sound that the locking of the lever has been completed.

DESCRIPTION OF EMBODIMENTS

A preferred embodiment of the present invention will now be described with reference to the drawings.

First, the construction of the lever-type connector of this embodiment will be described with reference to FIGS. 1 and 2.

Figure 1:
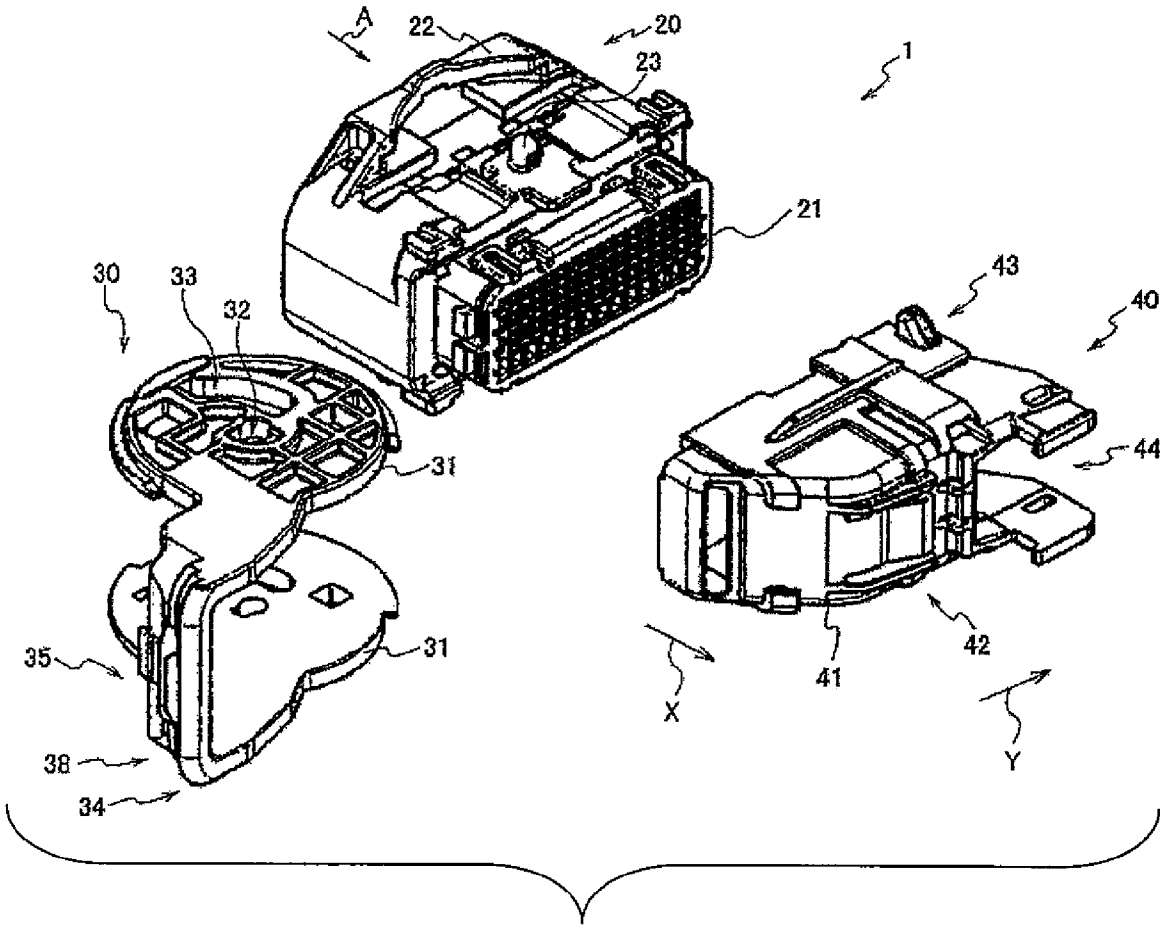
FIG. 1 is a perspective view of one embodiment of a lever-type connector of the present invention showing a condition before a fitted condition.
Figure 2:
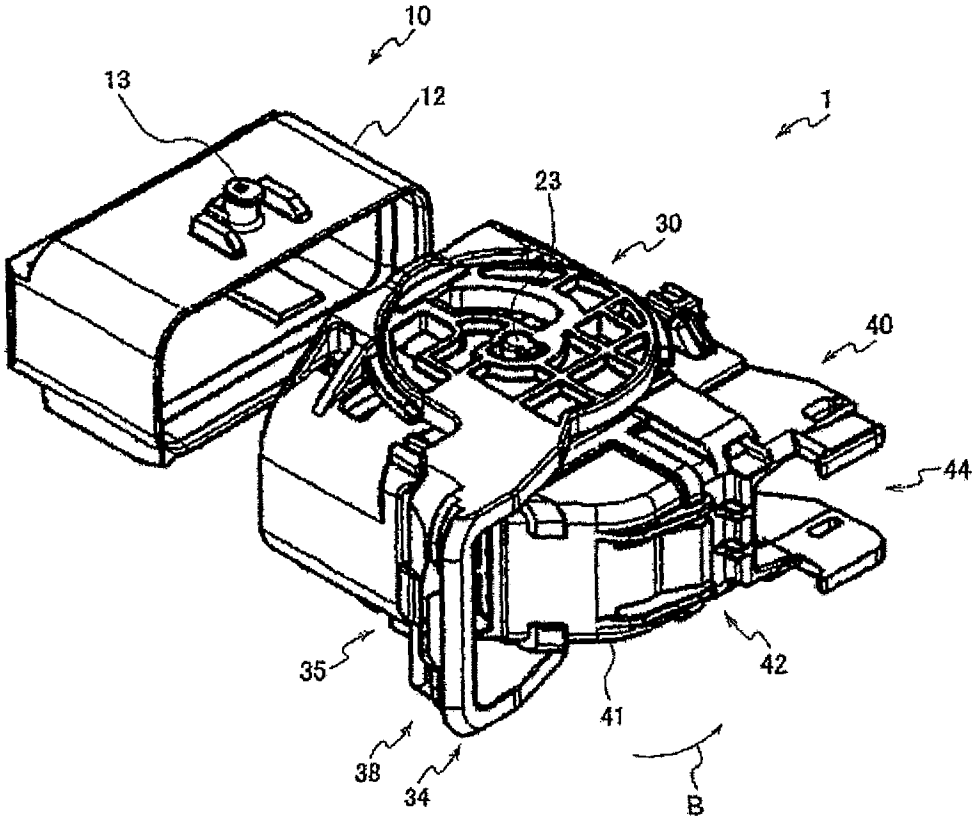
FIG. 2 is a perspective view of the lever-type connector of this embodiment, showing a partially-fitted condition.
Figure 3A:
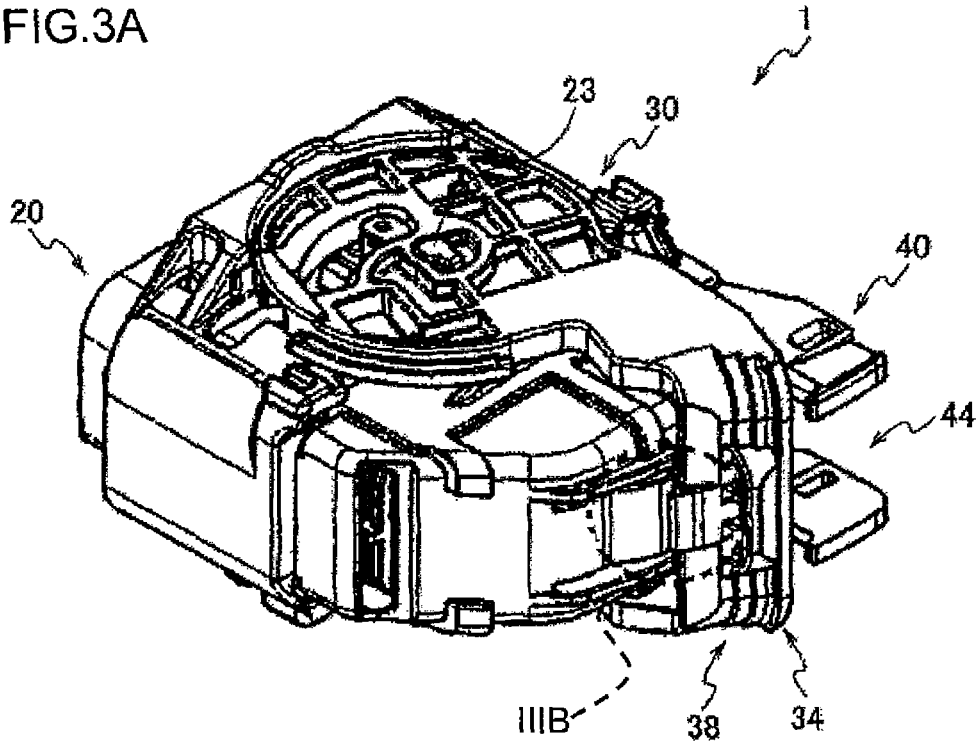
FIG. 3A is a perspective view of the lever-type connector of this embodiment, showing the fitted condition
Figure 3B:
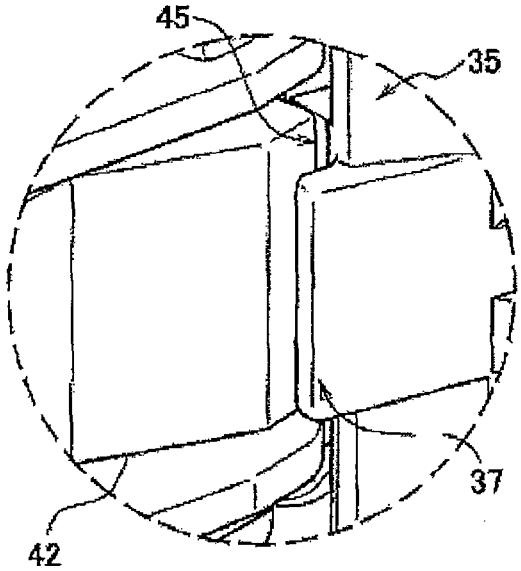
FIG. 3B is an Enlarged view showing a retaining portion and a lock portion of the lever-type connector.

As shown in FIGS. 1 and 2, the lever-type connector 1 broadly includes a female connector 10 and a male connector 20 which can be brought into and out of fitting connection with each other, and further includes a lever 30 rotatably mounted on the male connector 20, and a wire cover 40 of a generally dome-shape for leading wires W out to the exterior.

As shown in FIG. 2, the female connector 10 includes a connector body (not shown) having female connector-side terminal receiving chambers, a fitting hood 12 for fitting into the male connector 20, and a pair of cam pins 13 formed on and projecting respectively from left and right outer side surfaces of the fitting hood 12.

As shown in FIGS. 1 and 2, the male connector 20 includes a connector housing 22 having a plurality of male connector-side terminal receiving chambers 21 for respectively receiving terminals (not shown) connected respectively to end portions of the wires, and rotation axis pins 23 by which the lever 30 is rotatably mounted on the connector housing 22.

The lever 30 includes a pair of right and left arm portions 31 and 31, and an interconnecting portion 38 interconnecting these arms 31 and 31. Each of the arm portions 31 and 31 includes a rotation axis hole 32 for the insertion of the rotation axis pin 23 thereinto, a cam groove 33 formed such that the distance between this cam groove 33 and the rotation axis hole 32 is varying along the circumferential direction of the arm portion 31, and an operating portion 34 for pivotally moving the lever 30. The operating portion 34 is formed at the interconnecting portion 38, and the retaining portion 35 is formed at the operating portion 34. This retaining portion 35 has elasticity, and serves to retain the pivotally-moved lever 30.

Figure 4A:
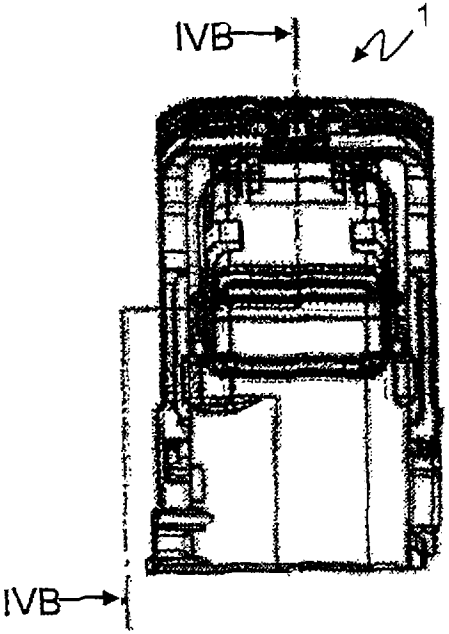
FIG. 4A is a side-elevational view of the lever-type connector of this embodiment showing an engaged condition.
Figure 4B:
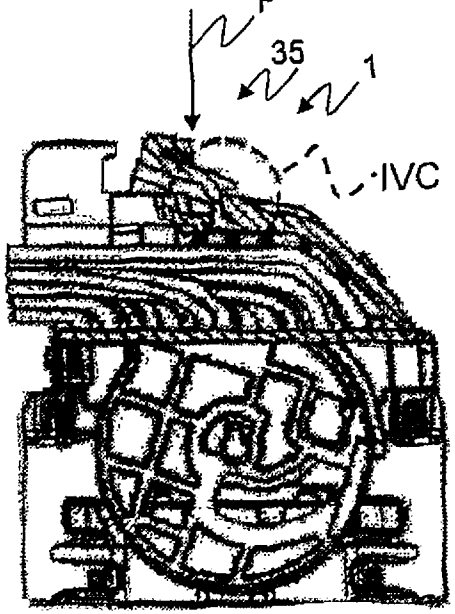
FIG. 4B is a cross-sectional view (taken along the line IVB-IVB) of the lever-type connector.
Figure 4C:
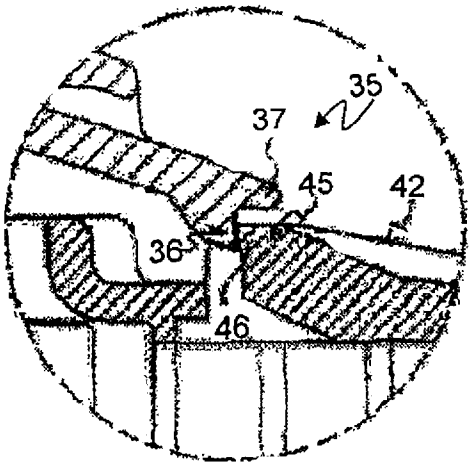
FIG. 4C is an enlarged view showing the retaining portion and the lock portion of the lover-type connector.

As shown in FIGS. 4A to 4C, a lever claw portion 36 is formed at the retaining portion 35, and is adapted to be retainingly engaged with the lock portion 45 (described later). Also, the lock protection portion 37 is formed at the retaining portion 35, and is provided at that side disposed in the direction of engagement of the lever claw portion 36 with the lock portion 45 so that the lock protection portion 37 can cover the lock portion 45.

As shown in FIGS. 1 and 2, the wire cover 40 includes a cover body 41 which receives the wires W therein generally over a longitudinal range of the connector housing 22 to lead the wires W as a wire bundle to the exterior in such a manner that the directions of the wires W led out from the connector housing 22 toward the wire cover 40 converge in a direction Y within the range of from 0° to 90° with respect to the direction X of leading-out of the wires W. The wire cover 40 further includes a lock arm 42 which has elasticity and is provided at a ceiling portion of a generally dome-shape.

The cover body 41 includes a cover portion 43 located to cover the male connector-side terminal receiving chambers 21, and a wire lead-out portion 44 for leading the wires W out from an opening formed in the cover body 41.

As shown in FIGS. 3A, 3B and FIGS. 4A to 4C, the lock portion 45 is formed at a distal end portion of the lock arm 42, and is retainingly engaged with the retaining portion 35 formed at the operating portion 34, as described above. More specifically, when the lever 30 is rotated, the lever claw portion 36 (see FIG. 4C) elastically deforms the lock arm 42 in a direction F (shown in FIGS. 4A, 4B, 5A, and 5B), and then slides over the lock portion 45 of the lock arm 42, so that a distal end engagement portion 46 of the lock portion 45 and the lever claw portion 36 are engaged with each other in a proper fitting position, thereby locking the lever 30.

As shown in FIGS. 4A to 4C and FIGS. 5A to 5C, the retaining portion 35 is formed into a generally V-shaped cross-section, and the lock protection portion 37 is so formed as to cover the lock portion 45 when the distal end engagement portion 46 of the lock portion 45 and the lever claw portion 36 are engaged with each other. Therefore, the lock portion 45 is not exposed to the exterior, and therefore even when an external force is applied, the force will not be applied directly to the lock portion 45, and therefore the lock portion 45 can be positively prevented from damage and deformation. In addition, the lock protection portion 37 thus covers the lock portion 45, and therefore even when a force is applied from the exterior, the locked lever 30 will not be accidentally pivotally moved, and the fitted condition of the female and male connectors 10 and 20 will not be canceled.

Figure 5A:
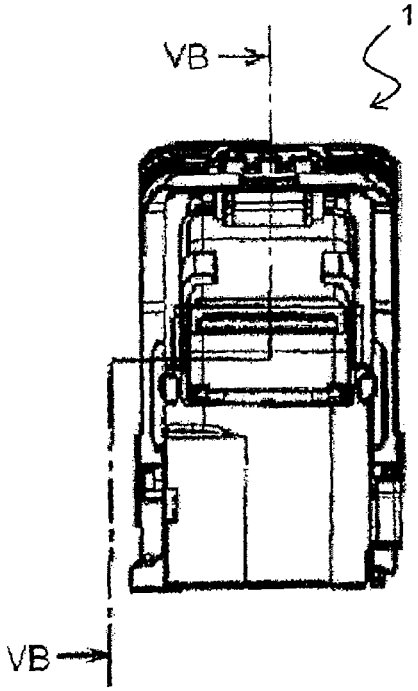
FIG. 5A is a side-elevational view of the lever-type connector of this embodiment showing a condition in which the lock portion abuts against a lock protection portion after the completely fitting condition is obtained.
Figure 5B:
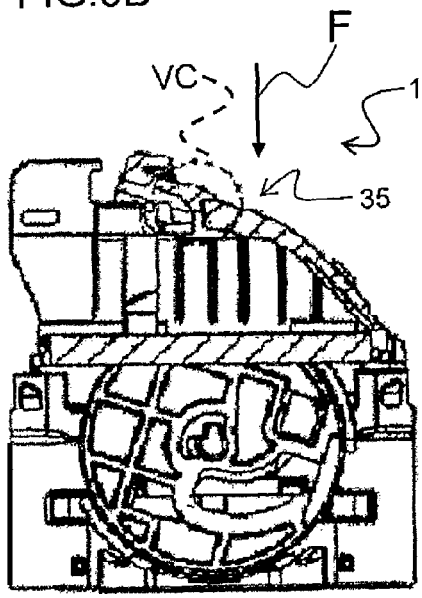
FIG. 5B is a cross-sectional view (taken along the line VB-VB) of the lever-type connector of FIG. 5A.
Figure 5C:
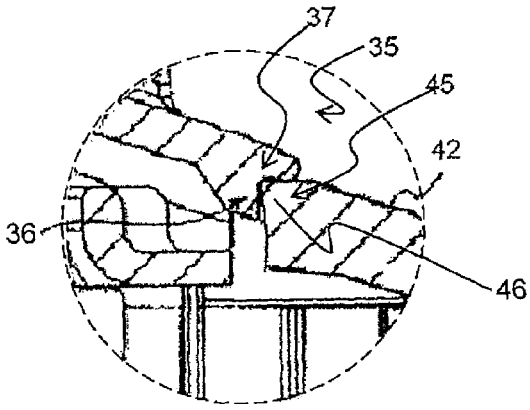
FIG. 5C is an enlarged view showing the retaining portion and the lock portion of the lever-type connector of FIG. 5A.
Figure 6:
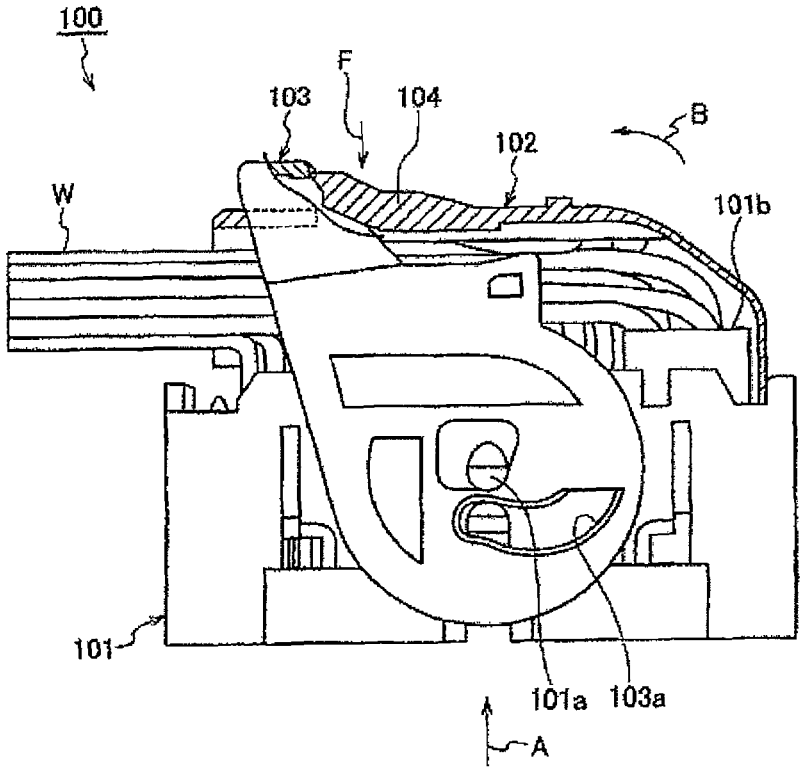
FIG.6 PRIOR ART
FIG. 6 is a side-elevational view of a conventional lever-type connector.

As shown in FIGS. 5A to 5C, the lock portion 45 is so formed as to be able to be disposed between the lever claw portion 36 and the lock protection portion 37 in abutting relation thereto. When the lever 30 is rotated, the lever claw portion 36 elastically deforms the lock arm 42 in the direction F (FIGS. 4B and 5B), and then slides over the lock portion 45 of the lock arm 42, so that the distal end engagement portion 46 of the lock portion 45 and the lever claw portion 36 are engaged with each other in the proper fitting position, and at this time the lock portion 45 abuts against the lock protection portion 37 by its own elastic force (see FIG. 5C) since the lock arm 42 has elasticity. Thus, since the lock portion 45 strikes against the lock protection portion 37, a large lock sound can be obtained. It can be confirmed from this lock sound that the locking of the lever 30 has been completed.

Furthermore, when the lock portion 45 abuts against the lock protection portion 37, the struck surface of the lock protection portion 37 is substantially parallel to the striking surface of the lock portion 45 as shown in FIGS. 5B and 5C, and the lock portion 45 and the lock protection portion 37 abut against each other at their flat surfaces, and therefore a larger lock sound can be obtained.

Furthermore, in order to obtain a large lock sound, an elastic reaction force of the lock arm 42 may be increased, and also the speed of restoration of the lock portion 45 from its elastically-deformed condition may be increased. Furthermore, the retaining portion 35 of the lever 30 and the lock portion 45 of the lock arm 42 may be formed respectively by lock sound-generating members which can generate a large lock sound upon striking.

Next, the fitting operation of the lever-type connector 1 of this embodiment will be described.

First, the wire cover 40 is attached to the connector housing 22 in a manner to cover the upper surface thereof, and then the rotation axis pins 23 of the connector housing 22 are passed respectively through the rotation axis holes 32 of the lever 30, thereby rotatably mounting the lever 30 on the connector housing.

Then, the operator inserts the female connector 10 into the connector housing 22 of the male connector 20 from a direction of arrow A (in FIG. 1). The cam pins 13 of the female connector 10 inserted in the connector housing 22 are brought into engagement respectively with the cam grooves 33 of the lever 30, and the female connector 10 is set in the half-fitting position relative to the connector housing 22.

Then, when the lever 30 located in the standby position (shown in FIG. 2) is rotated in a direction of arrow B (in FIG. 2), each cam pin 13 receives a pressing force form the corresponding cam groove 33 as a result of this rotating operation, and the terminals of the female connector 10 are gradually shifted toward the proper fitting position in the connector housing 22. Also, when the rotating lever 33 reaches a position just before the lock position (shown in FIG. 3A), the lever claw portion 36 of the retaining portion 35 elastically deforms the lock arm 42 of the wire cover 40 in the direction F (FIGS. 4B and 5B), and then slides over the lock portion 45 of the lock arm 42, so that the distal end engagement portion 46 of the lock portion 45 and the lever claw portion 36 are engaged with each other in the proper fitting position, and at this time the lock portion 45 abuts against the lock protection portion 37 by its own elastic force.

Next, the operation for canceling the fitted condition of the lever-type connector 1 of this embodiment will be described.

First, the operator depresses the lock portion 45 in the direction F (in FIGS. 4B and 5B), and then when the lever 30 located in the lock position is rotated to the standby position (shown in FIG. 2), the terminals of the female connector 10 are moved from the proper fitting position to the half-fitting position. When the operator separates the terminals of the female connector 10, located in the half fitting position, from the connector housing 22, the fitting cancellation operation of the female connector 10 is completed.

As described above, the lever-type connector 1 of this embodiment includes the connector housing 22 receiving the terminals connected respectively to the end portions of the wires, the wire cover 40 attached to the wire lead-out side of the connector housing 22 so as to lead the wires out to the exterior, the lever 30 which is rotatably mounted on the connector housing 22 and is rotated when the female connector 10 is disposed in the half-fitted condition relative to the connector housing 22, thereby moving the female connector 10 from the half-fitting position to the proper fitting position, the retaining portion 35 formed at the lever 30, and the lock portion 45 which is formed at the wire cover 40 and is retainingly engaged with the retaining portion 35 of the lever 30 when the lever 30 has been operated to properly fit the connector housing 22 and the female connector 10 together. The lever claw portion 36 is formed at the retaining portion 35, and the lock portion 45 is formed at the distal end portion of the lock arm 42, and one of the retaining portion 35 and the lock arm 42 has elasticity, and the lock protection portion 37 is formed at that side disposed in the direction of engagement of the lever claw portion 36 with the lock portion 45 so that the lock protection portion 37 can cover the lock portion 45.

In the lever-type connector 1 of this embodiment, the lock protection portion 37 is formed at the side disposed in the direction of engagement of the lever claw portion 36 of the lever 30 with the lock portion 45 of the wire cover 40 so that the lock protection portion 37 can cover the lock portion 45. Therefore, after the lever claw portion 36 and the lock portion 45 are retainingly engaged with each other to thereby lock the lever 30, the lock protection portion 37 covers the lock portion 45, and the lock portion 45 can be positively prevented from damage and deformation.

Furthermore, since the lock protection portion 37 covers the lock portion 45, the locked condition of the lever 30 will not be canceled even when a force is applied from the exterior. Therefore, there can be provided the lever-type connector 1 in which such damage and deformation are prevented, and the lock holding force is high.

Furthermore, in the lever-type connector 1 of this embodiment, the lock arm 42 has elasticity, and when the lever 30 is rotated, the lever claw portion 36 elastically deforms the lock arm 42, and then slides over the lock portion 45 of the lock arm 42, so that the distal end engagement portion 46 of the lock portion 45 and the lever claw portion 36 are engaged with each other in the proper fitting position, and at this time the lock portion 45 abuts against the lock protection portion 37 by its own elastic force.

In the lever-type connector 1 of this embodiment, the distal end engagement portion 46 of the lock portion 45 and the lever claw portion 36 are engaged with each other, and also the lock portion 45 abuts against the lock protection portion 37 by its own elastic force, and therefore a lock sound can be obtained, and it can be confirmed from this lock sound that the locking of the lever has been completed.

Although the lever-type connector of the present invention has been described above with respect to the illustrated embodiment, the invention is not limited to this embodiment, the constructions of the various portions can be replaced by arbitrary constructions having similar functions.

For example, in the above embodiment, although the lock protection portion 37 of the lever-type connector 1 is formed into the generally V-shaped cross-section, this lock protection portion can be suitably modified in so far as it is formed into such a shape as to cover the periphery of the lock portion 45.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2010-006113 filed on Jan. 14, 2010, the contents of which are incorporated herein by reference.

INDUSTRIAL APPLICABILITY

In the present invention, damage and deformation of the lever-type connector for fitting the mating connector thereto by rotating the lever are prevented, and therefore the invention is quite useful in increasing the lock holding force.

REFERENCE SIGNS LIST

1 lever-type connector
10 female connector
12 fitting hood
13 cam pin
20 male connector
21 male connector-side terminal receiving chamber
22 connector housing
23 rotation axis pin
30 lever
31 arm portion
32 rotation axis hole
33 cam groove
34 operating portion
35 retaining portion
36 lever claw portion
37 lock protection portion
38 interconnecting portion
40 wire cover
41 cover body
42 lock arm
43 cover portion
44 wire lead-out portion
45 lock portion
46 distal end engagement portion

The invention claimed is:

1. A lever-type connector comprising:

a connector housing configured to receive terminals connected respectively to end portions of electric wires;

a cover that is attached to the connector housing so as to lead the electric wires out to the exterior;

a lever that is rotatably mounted on the connector housing and is rotated in a situation that a mating connector is fitted to the connector housing in a half-fitted condition, thereby moving the mating connector with respect to the connector housing from the half-fitting condition to a completely fitting condition in which the mating connector is completely fitted to the connector housing;

a retaining portion that is provided on the lever and having a top surface; and a lock portion that is provided on a lock arm of the cover and is engaged with the retaining portion of the lever when the lever has been rotated thereby completely fitting the connector housing to the mating connector, wherein a lever claw portion is provided on the retaining portion;

wherein the lock portion is provided on a distal end portion of the lock arm;

wherein at least one of the retaining portion and the lock arm has elasticity; and wherein a lock protection portion is provided on the retaining portion so as to be positioned away from a rotation center of the lever than the lever claw portion so that the lock protection portion covers the lock portion, wherein the lock protection portion protrudes from the retaining portion in a rotating direction of the lever and projects upward from the top surface of the retaining portion.

2. The lever-type connector according to claim 1, wherein the lock arm has elasticity; and wherein when the lever is rotated, the lever claw portion elastically deforms the lock arm, and then slides over the lock portion of the lock arm, so that a distal end engagement portion of the lock portion and the lever claw portion are engaged with each other in the proper fitting condition and the lock portion abuts against the lock protection portion by an elastic force of the lock arm.

3. The lever-type connector according to claim 2, wherein in response to the distal end engagement portion of the lock portion and the lever claw portion being engaged with each other in the proper fitting condition, the lock portion abuts against the lock protection portion and the distal end engagement portion of the lock portion is flushed with a distal end of the retaining portion.

4. The lever-type connector according to claim 3, wherein a width of the lock protection portion is less than a width of the retaining portion.

5. The lever-type connector according to claim 1, wherein the lever claw portion projects downwards from a bottom surface of the retaining portion.

* * * * *